US008739706B2

(12) United States Patent
Dubois et al.

(10) Patent No.: US 8,739,706 B2
(45) Date of Patent: Jun. 3, 2014

(54) PLASTIC PALLET

(75) Inventors: Jean-Marc Dubois, Engelberg (CH); Yves Hug, Lieli (CH); Boris Schwab, Endingen (CH)

(73) Assignee: Georg Utz Holding AG, Bremgarten (CH)

( * ) Notice: Subject to any disclaimer, the term of this patent is extended or adjusted under 35 U.S.C. 154(b) by 0 days.

(21) Appl. No.: 13/576,333

(22) PCT Filed: Jan. 28, 2011

(86) PCT No.: PCT/IB2011/050372

§ 371 (c)(1),
(2), (4) Date: Jul. 31, 2012

(87) PCT Pub. No.: WO2011/092649

PCT Pub. Date: Aug. 4, 2011

(65) Prior Publication Data

US 2012/0304898 A1 Dec. 6, 2012

(30) Foreign Application Priority Data

Feb. 1, 2010 (CH) ..... 0117/10

(51) Int. Cl.
*B65D 19/12* (2006.01)

(52) U.S. Cl.
USPC ..... 108/56.1; 108/57.25

(58) Field of Classification Search
USPC ..... 108/52.1, 56.1, 57.17, 57.2, 57.22, 108/57.21, 57.23, 57.25, 57.26, 57.31, 108/57.28
See application file for complete search history.

(56) References Cited

U.S. PATENT DOCUMENTS

| | | | | |
|---|---|---|---|---|
| 3,664,271 | A * | 5/1972 | Wolder et al. | 108/57.26 |
| 5,094,175 | A * | 3/1992 | Christie | 108/56.1 |
| 5,413,052 | A * | 5/1995 | Breezer et al. | 108/56.1 |
| 7,490,561 | B1 * | 2/2009 | Chou | 108/56.1 |
| 8,006,629 | B2 * | 8/2011 | Naidu | 108/56.3 |
| 2001/0029874 | A1 | 10/2001 | Muirhead | |
| 2003/0110990 | A1 | 6/2003 | Apps | |
| 2006/0032413 | A1 | 2/2006 | Ogburn et al. | |
| 2006/0032414 | A1 | 2/2006 | Apps | |
| 2008/0105168 | A1 * | 5/2008 | Lee | 108/56.1 |
| 2009/0145339 | A1 | 6/2009 | Dubois et al. | |
| 2009/0183655 | A1 * | 7/2009 | Ogburn | 108/57.25 |
| 2010/0212553 | A1 * | 8/2010 | Baltz | 108/57.25 |
| 2011/0174197 | A1 * | 7/2011 | Seger | 108/57.25 |
| 2011/0174809 | A1 | 7/2011 | Dubois et al. | |
| 2012/0325125 | A1 * | 12/2012 | Apps et al. | 108/57.25 |
| 2013/0220184 | A1 * | 8/2013 | Apps et al. | 108/56.1 |

FOREIGN PATENT DOCUMENTS

| | | | |
|---|---|---|---|
| CH | 685549 | A5 | 8/1995 |
| DE | 2 149 501 | | 4/1973 |
| EP | 0 979 778 | A2 | 2/2000 |
| EP | 1 970 318 | A1 | 9/2008 |
| EP | 2 080 705 | A1 | 7/2009 |
| FR | 2 715 127 | | 7/1995 |
| WO | WO 00/68100 | | 11/2000 |

* cited by examiner

*Primary Examiner* — Daniel Rohrhoff
(74) *Attorney, Agent, or Firm* — Henry M. Feiereisen LLC

(57) ABSTRACT

A plastic pallet includes a hollow lower part provided with ribs and runners, and an upper part provided with ribs and welded to the lower part. The lower part has a recessed border and the upper part has an edge that is bent downwards, covering the edge of the lower part.

10 Claims, 5 Drawing Sheets

PLASTIC PALLET

CROSS-REFERENCES TO RELATED APPLICATIONS

This application is the U.S. National Stage of International Application No. PCT/IB2011/050372, filed Jan. 28, 2011, which designated the United States and has been published as International Publication No. WO 2011/092649 A1 and which claims the priority of Swiss Patent Application, Serial No. 00117/10, filed Feb. 1, 2010, pursuant to 35 U.S.C. 119 (a)-(d).

BACKGROUND OF THE INVENTION

The invention relates to a plastic pallet.

A plastic pallet is known, for example, from CH-A-685 549, and is made of an upper part or deck and a lower part with longitudinal runners which are interconnected by mirror welding. The top side and the bottom side are provided with ribs, giving the pallet a lower weight while still retaining the necessary stability. For additional reinforcement, metal pipes may be provided in crescent-shaped cut-outs disposed in the ribs of the lower part. The ribbing of the upper part matches the geometry of the ribbing of the bottom part, so that the end faces of the ribs of both parts are welded together. For connecting the upper part congruently with the lower part, these parts must be produced with precision in a high-quality production process. In particular, the ribs of the upper part and the ribs of the lower part must be exactly aligned with each other so that the pallet has at the edges a smooth surface without burrs.

In addition, a closed pallet with a so-called milling line is described in EP-A-1970318, wherein the upper part and the lower part are connected with one another at the edges. When the upper part is welded to the lower part, a bead is formed which must be removed in a milling process so that the pallet has a smooth surface. The problem with the milling process and the weakening of the material in the edge region of such a plastic pallet are described therein in detail. The bead is milled manually by an operator, so it depends on the operator's abilities whether more or less material is milled away.

It is an object of the present invention to provide a plastic pallet specify which allows easy manipulation when the upper part is connected to the lower part with a smooth border.

SUMMARY OF THE INVENTION

According to one aspect of the present invention, this object is achieved by a holder for a plastic pallet having a hollow lower part with ribs, runners and a border, and an upper part with a ribs and welded to the lower part. The border of the lower part has a protruding shoulder and is recessed in relation to the upper part. The upper part has a downwardly bent edge which encompasses the border of the lower part. A front end of the bent edge is supported on the protruding shoulder and welded to the protruding shoulder. An upper edge of the border is welded to a bottom side of the upper part, forming a crumple zone between the edge and the border.

The novel plastic pallet has the great advantage that a smooth full-surface connection between the upper and the lower part can be achieved with high precision and with a smooth border. This eliminates reworking of the border.

BRIEF DESCRIPTION OF THE DRAWING

Further advantages of the invention can be inferred from the dependent claims and from the following description in which the invention is explained in detail with reference to an exemplary embodiment illustrated in the schematic drawings. It is shown in:

DETAILED DESCRIPTION OF PREFERRED EMBODIMENTS

Figure 1:
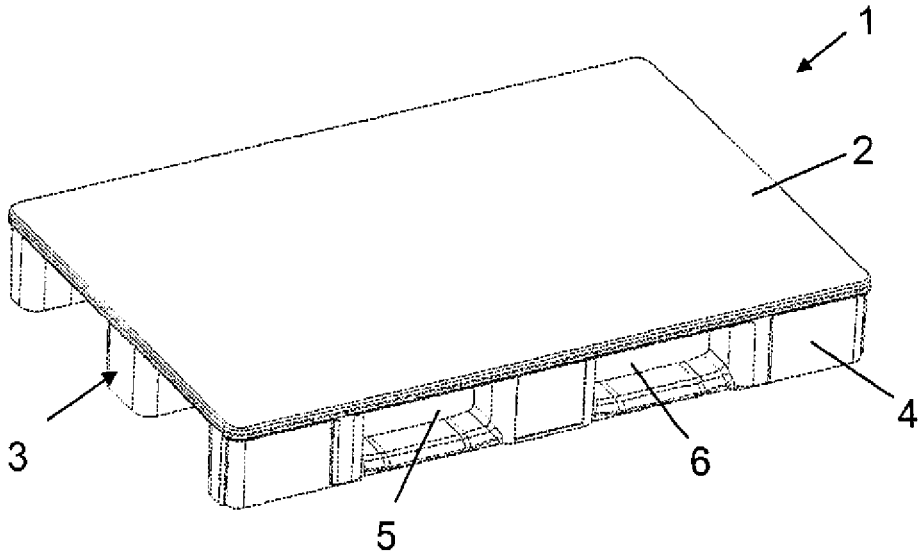
FIG. 1 a plastic pallet in a welded-together state

In the Figures, the same reference numerals are used for the same elements, and the explanations for a particular reference number apply to all Figures, unless a different explanation is explicitly given.

FIG. 1 shows a plastic pallet 1 with an upper part or deck 2 and a lower part 3 having runners 4 arranged in rows with lateral recesses 5 and 6. The upper part has a perfectly smooth surface, so the pallet can be easily cleaned and has no discontinuities where dirt or bacteria could accumulate, and is therefore ideally suited for applications in hygiene and clean room applications.

Figure 2:
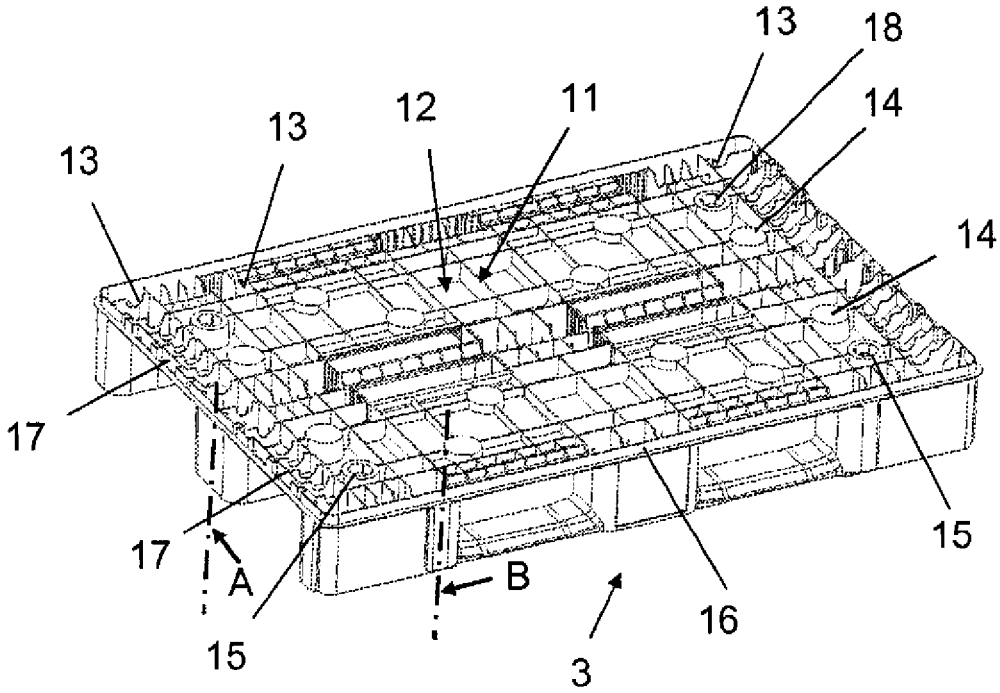
FIG. 2 the lower part of the plastic pallet from above.

FIG. 2 shows the bottom part 3 from above, which has a rib structure 11 in the cavities 12 for significant weight savings and for providing mechanical stability. Furthermore, semicircular recesses 13 configured to receive reinforcing tubes 21 made of metal or a suitable hard plastic material are provided in the rib structure 11 (see FIG. 4). In addition, first projections 14 shaped as circular cylinders are distributed uniformly over the surface. Circular cylindrical pipe sections or cylinders 15 configured for engagement with centering pins 22 of the upper part 2 are disposed at the corner regions of the bottom part 3 (see FIG. 6). The pipe sections or cylinders 15 include four small vertical webs 18 regularly distributed on the inner edge, which operate to center the pin 22. In addition, a slightly recessed border 16 with protruding projections 17, which is configured to be encompassed by the downwardly bent edge 23 of the upper part, is disposed on the short sides of the lower part 3 (see FIGS. 6 and 7).

Figure 3:
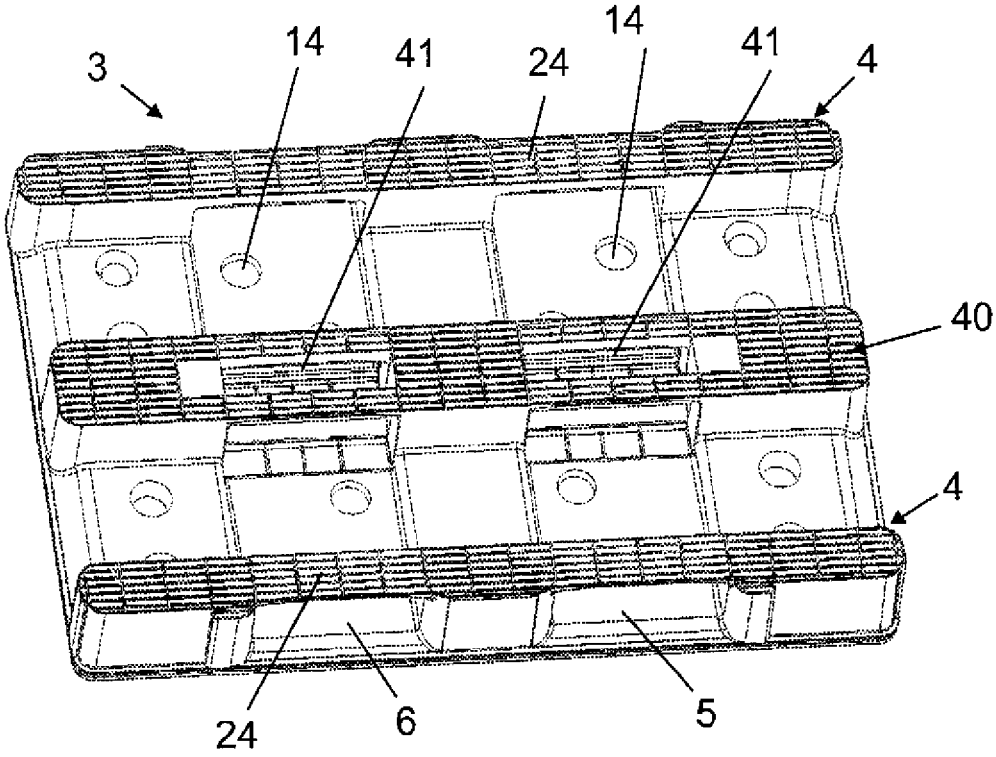
FIG. 3 the lower part of the plastic pallet from below.

FIG. 3 shows the upper part 3 from below, with the longitudinal runners 4 with a ribbed profile 24 now clearly visible. Furthermore, the circular-cylindrical projections 14, which are formed to have less depth in the shallower areas, are also visible from below. The center longitudinal runner 40 has corresponding rectangular recesses 41 in the region of the recesses 5 and 6, which are produced by molding with an injection mold and mold cores.

Figure 4:
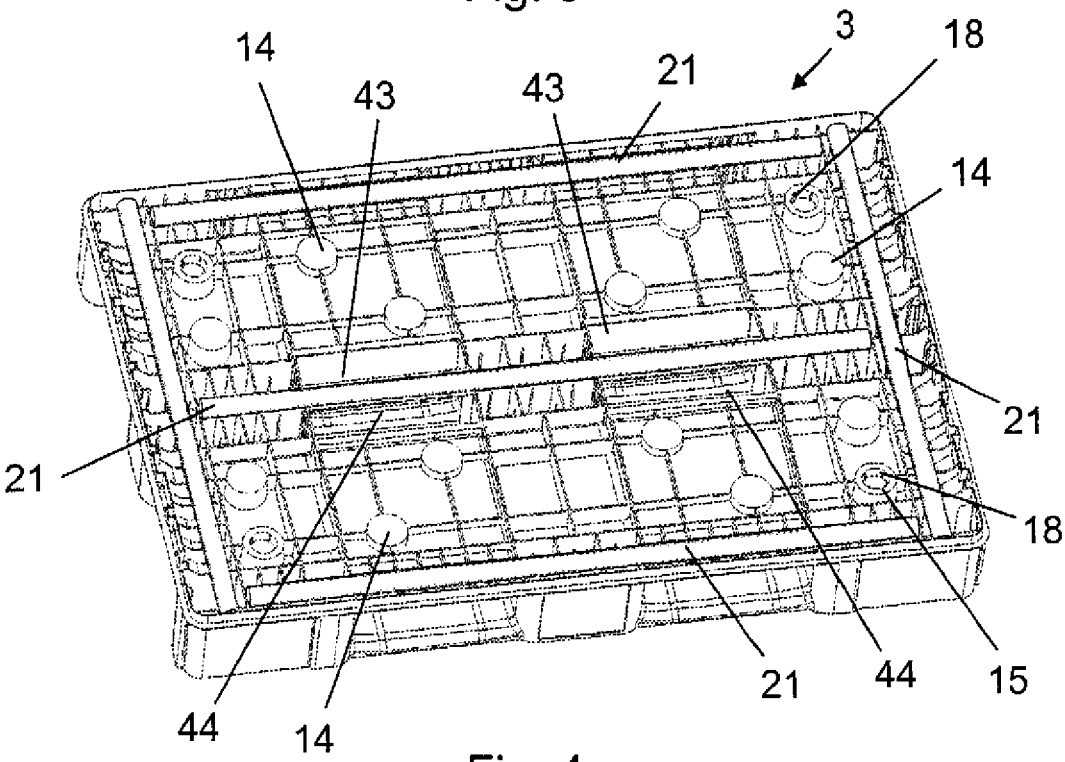
FIG. 4 the lower part of the plastic pallet with metal tubes from above.

FIG. 4 shows a perspective view on the upper part 3 from above, wherein the reinforcing tubes 21 are herein made of metal or a suitable rigid plastic such as polycarbonate (PC) or polyoxymethylene (POM). Rectangular recesses 43 and 44 are here also disposed on both sides of the central reinforcing tube 21 in the region of the recesses 5 and 6, which are required for demolding of the central longitudinal runner 40.

Figure 5:
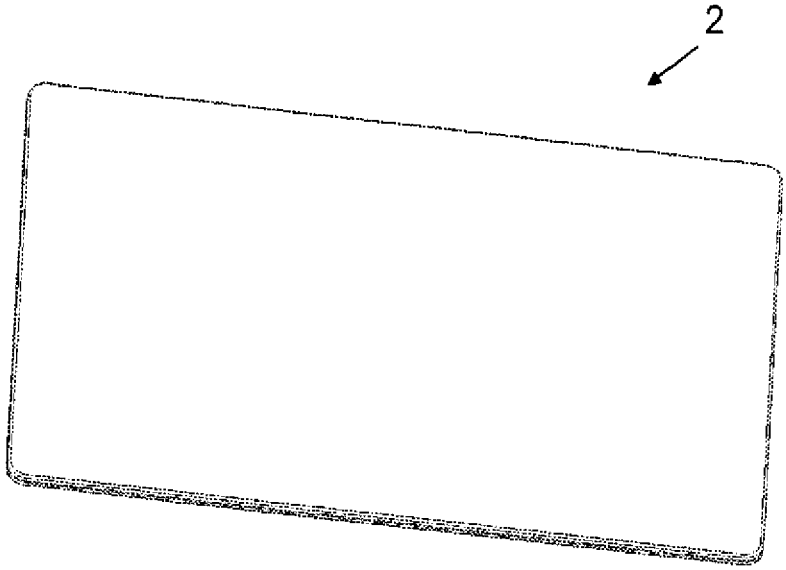
FIG. 5 the upper part or deck of the plastic pallet from above.
Figure 6:
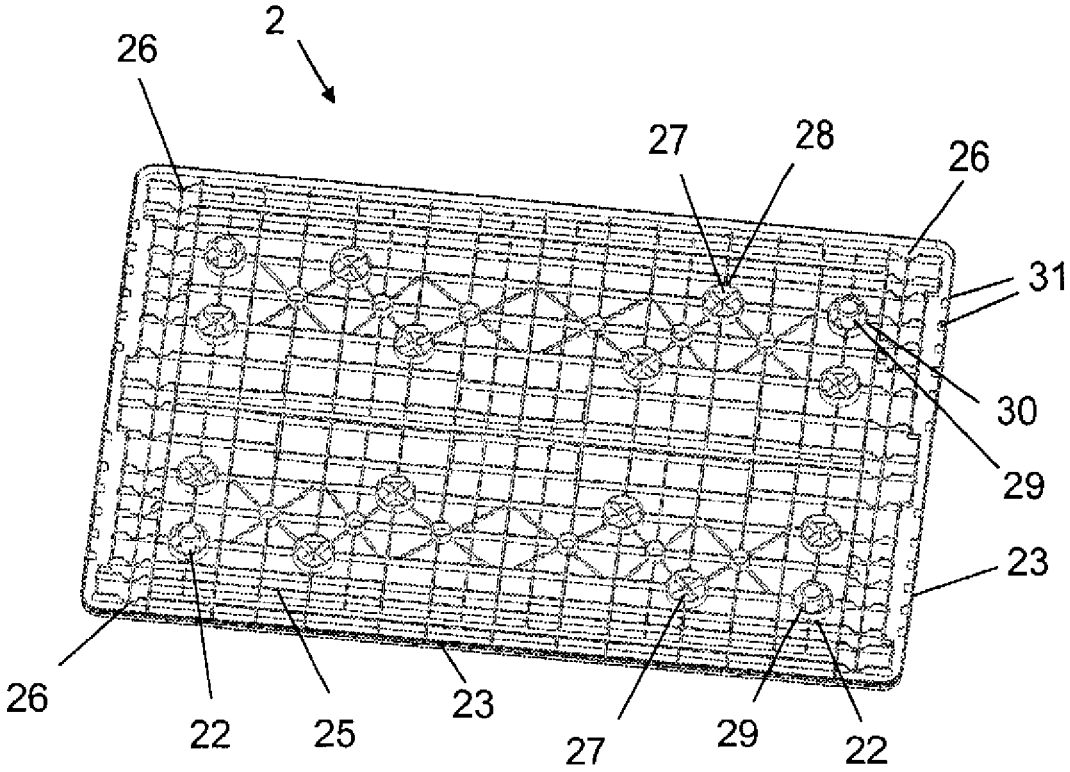
FIG. 6 the upper part from below.

FIG. 5 shows the upper part or deck 2 from above, whereas FIG. 6 shows the upper part or deck 2 from below. A ribbed structure 25 with semicircular recesses 26 for the reinforcement tubes 21 is here also evident. Moreover, cross-shaped second protrusions 27 are provided, which each have a surrounding projecting ring 28 and which face the circular-cylindrical projections 14 when the upper part 2 is placed on the lower part 3. In addition, projecting pins 22, which fit into the circular-cylindrical pipe sections 15 of the lower part 3, are arranged in the corner regions. These pins 22 are formed as annular cylinders and have outwardly facing webs 29 which are connected to an outer ring 30. When the upper part 2 is placed onto the lower part 3, the outer ring 30 rests on the respective pipe section 15, while leaving a small clearance between the pins 22 and the pipe sections 15. The upper part 2 and bottom part 3 are then joined together by friction welding or vibration welding. The upper part 2 is hereby welded together with the lower part 3 in an orbiting or rapid reciprocating movement. Thus, the first protrusions 14 of the upper part 2 are welded together with the second protrusions 27 of the lower part 3, and the outer rings 30 are likewise welded together with the pipe sections 15. However, other welding processes such as mirror welding may be used. Also visible is the peripheral curved edge 23 of the upper part 2, which is provided with perpendicular, inwardly pointing webs 31, which operate to align the edge 23 of the upper part 2 with respect to the border 16 having the protrusions 17 of the lower part 3. The projections 17 add stability to the shorter sides of the border 16, so that these are not carried along at their top edge by the upper part 2 in the longitudinal direction during vibration welding. In this way, a particularly stable connection between the upper part 2 and the lower part 3 is also attained at the shorter sides of the pallet. The aforedescribed joint produced by vibration welding is particularly economical, because removal of protruding ridges is entirely eliminated.

Figure 7:
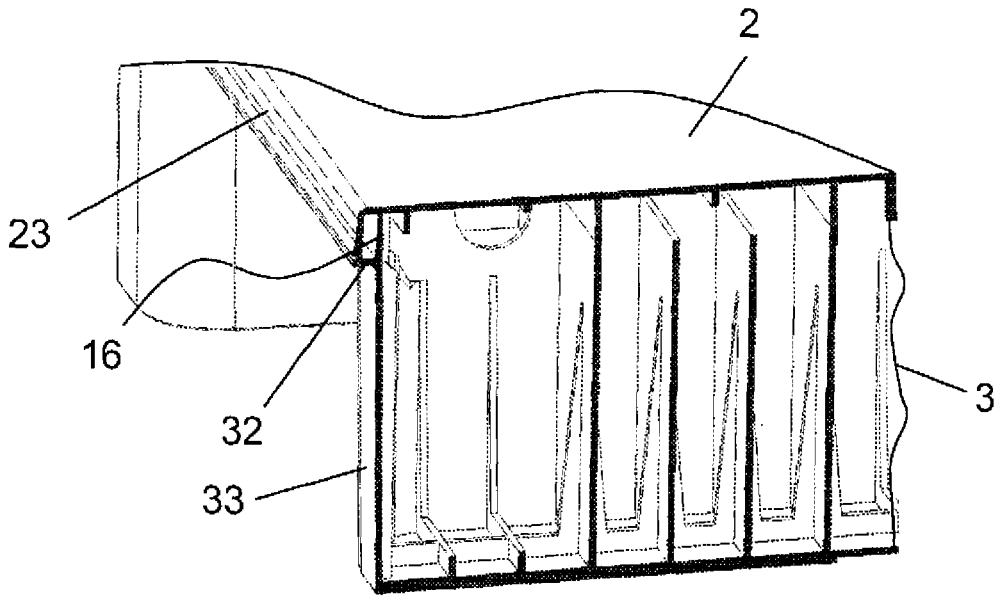
FIG. 7 a partial cross-section through the plastic pallet in the direction A of FIG. 2, FIG. 8 a partial cross-section through the plastic pallet in the direction B of FIG. 2, FIG. 9 a modified embodiment of the plastic pallet from above, and FIG. 10 the modified embodiment of the plastic pallet from below.

FIG. 7 shows a partial cross section through the plastic pallet 1 in the direction A of FIG. 2, clearly showing the circumferentially curved edge 23 of the upper part 2 and the rim 16 of the lower part 3. A circumferential shoulder 32 is also visible, on which the front end of the bent edge 23 is supported, i.e. where the edge 23 is welded to the shoulder 32 during vibration welding. The upper edge of the border 16 is also welded to the underside of the upper part 2. This produces a so-called a crumple zone, i.e., provides double protection against lateral damage to the pallet: when the welded connection between edge 23 and the shoulder 32 detaches due to damage, the welded connection between the border 16 and the upper part 2 still remains intact. At the same time, a smooth border of the pallet 1 is attained, which does not require finishing. The outer wall 33 below the shoulder 32 is arranged with an inward offset.

Figure 8:
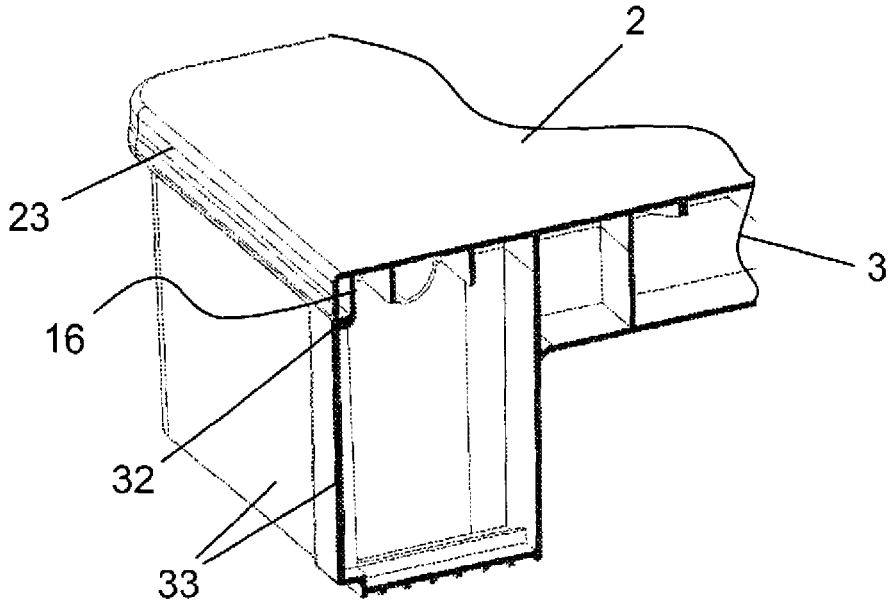

FIG. 8 shows a partial cross-section through the plastic pallet 1 in the direction B of FIG. 2; the outer wall 33 is formed substantially flush with the edge 23 in this region.

As is apparent from the above, the plastic pallet 1 has the same dimensions both at the top of the deck 2 as well as at the runners 4—at least in the corner areas important for transport and further handling. Thus, the plastic pallet 1 can be used in more demanding applications as a complete replacement for the well-known wooden pallets (Euro-Pallets).

The reinforced plastic pallet 1 prepared in this way and equipped with reinforcement tubes 21 has a static load capacity of approximately 7,500 kg. The dynamic load capacity is between 1,000 and 1,300 kg.

Figure 9:
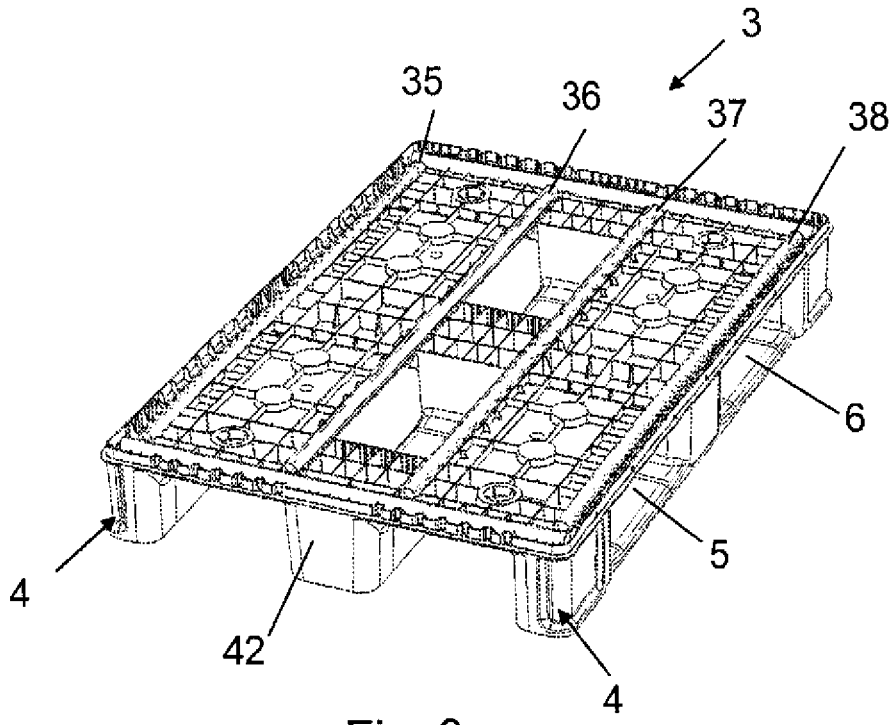
Figure 10:
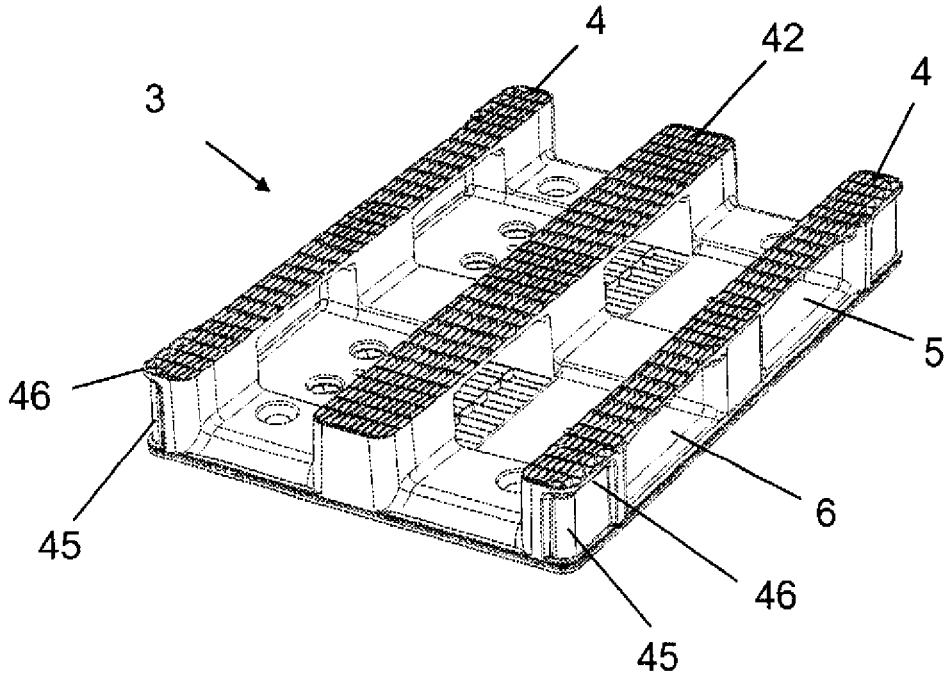

FIGS. 9 and 10 show a modified embodiment of the plastic pallet according to the FIGS. 1 to 8, wherein four reinforcing tubes 35, 36, 37 and 38 are now provided in the longitudinal direction. Since the center reinforcing tubes 36 and 37 are arranged on both sides of the longitudinal runner 42, the upper part or deck 2 has a closed weld with the lower part 3, thus preventing water from entering between these two parts. To prevent this in the first embodiment of the plastic pallet 1, an absolute seal must be provided between the deck 2 and the lower part 3 in the area of the openings 43 and 44 on both sides of the center reinforcing tube 21 (see FIG. 4). This cannot always be guaranteed when using vibration welding. The embodiment of the plastic pallet 1 of FIGS. 9 and 10 has the additional advantage that the center longitudinal runner 42 is closed and thus prevented from inadvertently getting stuck at the rectangular openings 41 (see FIG. 3). In all other aspects, the embodiment of the variant according to FIGS. 9 and 10 is constructed identical to the embodiment of FIGS. 1 to 8.

For attaining better centering on a lattice frame, the corner regions 45 of the outer longitudinal runners 4 are provided with a protruding outer edge 46, which matches the contour of the deck 2.

What is claimed is:

1. A plastic pallet comprising:

a hollow lower part having ribs, runners and a circumferential border, and an upper part having a rib and welded to the lower part, wherein the border of the lower part has a protruding circumferential shoulder and is recessed in relation to the upper part, and wherein the upper part has a circumferential downwardly bent edge which encompasses the border of the lower part and a front end of the bent edge is supported on the protruding shoulder and the front end is welded on the protruding shoulder to provide a smooth full-surface connection between the front end of the bent edge and the protruding shoulder, and wherein an upper edge of the border is welded to a bottom side of the upper part, forming a crumple zone between the bent edge of the upper part and the border of the lower part.

2. The plastic pallet of claim 1, wherein the border comprises outwardly projecting protrusions, and the bent edge comprises inwardly pointing webs oriented perpendicular to the projecting protrusions and being aligned with the projecting protrusions.

3. The plastic pallet of claim 1, wherein the upper part is additionally welded together with the border of the lower part at the bent edge.

4. The plastic pallet of claim 1, wherein the lower part comprises first projections uniformly distributed over a surface of the lower part, and wherein the upper part comprises second projections opposing the first projections, with the upper part and the lower part being welded together at the first and second projections.

5. The plastic pallet of claim 4, wherein the first projections are flat raised portions and the second projections are cross-shaped ribs.

6. The plastic pallet of claim 5, wherein the first projections are circular and the cross-shaped ribs are surrounded by a protruding ring.

7. The plastic pallet of claim 1, wherein the lower part comprises cylinders disposed at corner regions of the lower part and the upper part comprises centering pins disposed at corner regions of the upper part and located opposite the cylinders and constructed to fit into the cylinders.

8. The plastic pallet of claim 7, wherein the cylinders comprise webs uniformly distributed on an inner wall of the cylinders, with the webs operating to center the pins of the upper part in the cylinders of the lower part.

9. The plastic pallet of claim 1, wherein the upper part and the lower part have identical outside dimensions in a region of the runners.

10. The plastic pallet of claim 9, wherein the runners are provided in corner region with a protruding outer edge which matches a contour of the upper part.

* * * * *